US008327856B2

(12) United States Patent
Robertson et al.

(10) Patent No.: US 8,327,856 B2
(45) Date of Patent: Dec. 11, 2012

(54) ENVIRONMENTALLY DEGRADABLE CIGARETTE FILTER

(75) Inventors: Raymond M. Robertson, Blacksburg, VA (US); William C. Thomas, Pembroke, VA (US)

(73) Assignee: Celanese Acetate LLC, Dallas, TX (US)

( * ) Notice: Subject to any disclaimer, the term of this patent is extended or adjusted under 35 U.S.C. 154(b) by 294 days.

(21) Appl. No.: 12/749,543

(22) Filed: Mar. 30, 2010

(65) Prior Publication Data

US 2011/0240045 A1 Oct. 6, 2011

(51) Int. Cl.
*A24D 3/04* (2006.01)

(52) U.S. Cl. ..... 131/345

(58) Field of Classification Search ..... 131/345, 131/332, 334

See application file for complete search history.

(56) References Cited

U.S. PATENT DOCUMENTS

| | | | | |
|---|---|---|---|---|
| 2,881,772 | A | 4/1959 | Touey et al. | |
| 5,417,682 | A * | 5/1995 | Wong et al. | 604/892.1 |
| 5,750,145 | A * | 5/1998 | Patell | 424/478 |
| 2009/0151738 | A1 * | 6/2009 | Robertson et al. | 131/332 |

OTHER PUBLICATIONS

J. Gu et al, "Cellulose Acetate Biodegradability Upon Exposure to Simulated Aerobic Composting and Anaerobic Bioreactor Environments," Jounal of Polymers and the Environment, (vol. 1), (Issue. 2), (p. 143-153), (1993).*

U.S. Appl. No. 12/687,912, filed Jan. 15, 2010, Robertson.

* cited by examiner

*Primary Examiner* — Richard Crispino
*Assistant Examiner* — Dionne Walls Mayes
(74) *Attorney, Agent, or Firm* — Hammer & Associates, P.C.

(57) ABSTRACT

An environmentally degradable cigarette filter includes a filter element of a bloomed cellulose acetate tow and a plug wrap surrounding said filter element. A weak organic acid and a pH adjusted inorganic ester salt are encapsulated in a matrix material which is in contact with the tow. The pH adjusted inorganic ester salt has a pH less than or equal to 8. When the cigarette filter is discarded into the environment, water liberates the weak acid and the ester salt from the matrix material. The weak acid hydrolyzes the ester liberating a strong acid. The strong acid catalyzes the degradation of the cellulose acetate tow. (The weak acid also hydrolyzes the cellulose acetate tow, but after the strong acid is generated, the strong acid becomes the dominant acid catalyst for the cellulose acetate tow degradation.)

18 Claims, No Drawings

ENVIRONMENTALLY DEGRADABLE CIGARETTE FILTER

FIELD OF THE INVENTION

The present invention is directed to an environmentally degradable cigarette filter.

BACKGROUND OF THE INVENTION

US Publication No. 2009/0151738, incorporated herein by reference, teaches that a degradable cigarette filter is obtained by contacting the cellulose acetate cigarette tow with, in one embodiment, a mixture of a water soluble matrix material and a combination of a weak organic acid and a compound that can be hydrolyzed to a strong acid.

The compounds that can be hydrolyzed to a strong acid are identified as: cellulose sulfate, dodecyl sulfate, ascobryl-2-sulfate, ascorbyl-2-phosphate, phosphorus pentoxide, phosphorus pentoxide based esters, cellulose nitrate, 2-ethyl hexyl phosphate, and combinations thereof. These compounds are esters of strong acids and many are unstable (meaning that they will decompose in a relatively short period of time and thereby making them unuseable in many applications). Therefore, these esters are typically provided commercially as a salt of the ester. These ester salts are stable and do not degrade over time like their non-salt versions. However, their stability inhibits their use in the instant application.

Accordingly, the foregoing compounds that can be hydrolyzed to strong acids must be modified to make them work more aggressively (i.e., hydrolyze into strong acids which in turn catalyze the degradation of the cellulose acetate) in the instant application.

SUMMARY OF THE INVENTION

An environmentally degradable cigarette filter includes a filter element of a bloomed cellulose acetate tow and a plug wrap surrounding said filter element. A weak organic acid and a pH adjusted inorganic ester salt are encapsulated in a matrix material which is in contact with the tow. The pH adjusted inorganic ester salt has a pH less than or equal to 8. When the cigarette filter is discarded into the environment, water liberates the weak acid and the ester salt from the matrix material. The weak acid hydrolyzes the ester liberating a strong acid. The strong acid catalyzes the degradation of the cellulose acetate tow. (The weak acid also hydrolyzes the cellulose acetate tow, but after the strong acid is generated, the strong acid becomes the dominant acid catalyst for the cellulose acetate tow degradation.)

DESCRIPTION OF THE INVENTION

An environmentally degradable cigarette filter generally includes a filter element (or filter plug) made of a bloomed cellulose acetate tow, a plug wrap surrounding the filter element, and a weak organic acid and a pH adjusted inorganic ester salt encapsulated in a matrix material. The encapsulated materials are in contact with the tow. Each of these components will be discussed in greater detail below.

An environmentally degradable cigarette filter, as used herein, refers to a cigarette filter that will decompose when exposed to an outdoor environment (i.e., exposed to rain, dew, or other sources of water). The degree of degradation is, at a minimum, sufficient to convert, all of or part of, the cellulose acetate (in cigarette filters, cellulose acetate generally has a Degree of Substitution (D.S.) of 2.0-2.6 into cellulose (D.S. ≦1.0), and, at a maximum, sufficient to convert the cellulose acetate into glucose. The time period for such degradation is less than the time for an equivalent amount of untreated cellulose acetate to decompose and typically may be several months (e.g., 2-6 months or less).

The filter element made of bloomed cellulose acetate tow and the plug wrap are conventional. The cellulose acetate tow is a cellulose diacetate with a D.S. in the range of 2.0 to 2.6. These are subsequently attached to the tobacco column of the cigarette in a known manner.

Weak organic acids include: ascorbic acid, citric acid, lactic acid, nicotinic acid, hydroxysuccinic acid (apple acid), and combinations thereof. Ascorbic acid and citric acid are preferred.

pH adjusted inorganic ester salts include organic sulfates salt and organic phosphates salt. The inorganic esters of strong acids may be unstable and readily decompose, so their applicability in the instant application may be compromised. Therefore, these esters are stabilized in their salt forms. These inorganic ester salts, however, are so stable that they can be difficult to hydrolyze and release their strong acid. If the inorganic ester salt is pH adjusted, it is somewhat less stable and is easier to hydrolyze. By pH adjusted, it is meant that some, but not all, of the metal portion (typically, a sodium or potassium, but not so limited) of the inorganic ester salt is dissociated (and thereby the pH of the inorganic ester salt in solution is lowered, i.e., made more acidic). The pH adjustment should be less than or equal to a pH of 8, or in the pH range of 2.5-8. In another embodiment, the pH range may be 3-7.5. In another embodiment, the pH range may be 4-7. In another embodiment, the pH range may be 5.3-7. The lower the pH, the faster degradation occurs; however, if the pH is too low, instability of the compound can have a negative impact. Additionally, organic compounds that accommodate multiple strong acid moieties are preferred because as they are hydrolyzed, they will release more strong acid.

Organosulfate salts include, but are not limited to: inositol hexasulfate hexapotassium salt; sucrose octasulfate octasodium salt; cellulose sulfate salt; dodecyl sulfate salt; glucose sulfate sodium salt; ascorbyl sulfate sodium salt; lauryl sulfate sodium salt; starch sulfate sodium salt; octyl sulfate sodium salt; and combinations thereof.

Organophosphate salts include, but are not limited to: inositol hexaphosphate hexapotassium salt; sucrose phosphate di-sodium salt; glucose phosphate di-sodium salt; ascorbyl phosphate di-sodium salt; lauryl phosphate di-sodium salt; starch phosphate sodium salt; 2-ethyl hexyl phosphate salt; octyl phosphate di-sodium salt; and combinations thereof.

The amount of the pH adjusted inorganic ester salt must be sufficient to cause degradation of all of, or part of, the cellulose acetate tow at a rate faster than an equivalent untreated filter element. For example, in one embodiment of the invention, the time for degradation may be 2-6 months. The amount of the pH adjusted inorganic ester salt will depend upon, for example: the weight of the cellulose acetate in the filter element, the desired time for degradation of the filter element, and the pH adjusted inorganic ester salt chosen (to name a few).

For example, if the target time for degradation is 2-6 months, then, in one embodiment, the amount of acid released from the pH adjusted inorganic ester salt may be in the range of 2-200% by weight of the cellulose acetate in the filter element. In another embodiment, using the same desired outcomes as above, the amount of acid released from the pH adjusted inorganic ester salt may be in the range of 5-100% by weight of the cellulose acetate. In yet another embodiment, the amount of acid released from the pH adjusted inorganic ester salt may be in the range of 10-50% by weight of the cellulose acetate.

The matrix material may be any water-soluble and/or water permeable material that can encapsulate (i.e., contain the weak organic acid and the pH adjusted inorganic ester salt); but, when in contact with water, will dissolve and/or allow water through to mix with the weak acid and the pH adjusted inorganic ester. Once mixed, acid catalyzed hydrolysis of pH adjusted ester start starts. Overtime, the catalyst(s) migrate into the cellulose acetate filter/butt and promote the hydrolysis of the cellulose acetate filter/butt. Encapsulation is important for, at least two reasons: first, encapsulation prevents premature hydrolysis, and second, maintains shelf-life of the product (filter). The water-soluble matrix material may be cellulose acetate (D.S.=0.8±0.2), carboxymethyl cellulose (CMC), ethyl cellulose, hydroxypropyl cellulose (HPC), hydroxypropyl methyl cellulose (HPMC), methyl cellulose, polyethylene glycol (PEG), polyvinyl acetate, polyvinyl alcohol, starch, sugar, and combinations thereof. The sugars may be glucose, sucrose, lactose, and combinations thereof. In most embodiments, the water-soluble matrix material may be carboxymethyl cellulose, hydroxypropyl cellulose, hydroxypropyl methyl cellulose, polyvinyl alcohol, polyethylene glycol, and combinations thereof. The water permeable materials may include ethyl cellulose, shellac, zein (a prolamine protein found in corn), cellulose acetate (D.S.=2.0-2.6), cellulose phthalate, porous silicone elastomers (i.e., silicone elastomers with added PEG, where the PEG dissolves out to form pores), acrylic esters (e.g., commercially available under the tradename EUDRAGIT from Evonik Degussa Corp., Piscataway, N.J.), and combinations thereof.

The amount of the matrix material should be sufficient to completely encapsulate the weak organic acid and the pH adjusted inorganic ester salt. Completely encapsulate refers to covering and isolating the weak organic acid and the pH adjusted inorganic ester salt, so that it cannot catalyze hydrolysis until water has dissolved away at least a part of the matrix material. Generally, the weight ratio of the weak organic acid and the pH adjusted inorganic ester salt to the water-soluble matrix material may be in the range of 0.75-4.0:1. In one embodiment, the ratio may be 2:1.

The weak organic acid and the pH adjusted inorganic ester salt and the matrix material may be in the form of a coating or a pill that is in contact with the tow. See US Publication No. 2009/0151738, incorporated herein by reference.

The coating may be applied to the cellulose acetate tow after the tow is manufactured (i.e., not added to the spinning solution) and/or to the plug wrap. In one embodiment, the mixture may be coated onto the tow prior to formation of the filter element. For example, in a conventional rod making machine, a solution of the mixture may be sprayed onto the bloomed tow prior to or as that tow passes the garniture. Alternatively, after the filter element is formed, a solution of the mixture may be injected (e.g., via a syringe) into the tow. In another embodiment, the mixture may be coated (or applied) as a line on an inside surface of the plug wrap.

The pill may be added to the filter element during cigarette filter manufacture. Pill, as used herein, may refer to, for example: a single pill comprising the mixture (which may or may not be enclosed in a gelatin capsule or cated with a protective barrier coating), or granules of the mixture, or a powder of the mixture, or a tablet of the mixture (e.g., the mixture alone or with a conventional tablet binder). The pill may be added to the cellulose acetate of the filter element prior to (or as) the filter element is being formed. For example, in a conventional rod making machine, a pill of the mixture may be inserted into the bloomed tow prior to or as that tow passes the garniture.

An alternative pill construction has the weak acid and the pH adjusted inorganic ester salt surrounded by an inner layer of a water soluble or water permeable material and an outer layer of a cellulose acetate having a D.S. in the range of 2.0-2.6 surrounding the inner layer. This pill construction is set forth in U.S. Ser. No. 12/687,912 filed Jan. 15, 2010, incorporated herein by reference. The components of this embodiment are described hereinafter.

The weak acid and the pH adjusted ester salt are as previously described.

The inner layer and the outer layer that surround and encapsulate the weak acid and the pH adjusted inorganic ester salt so that 1) excess water does not merely wash away the weak acid and the pH adjusted inorganic ester salt and there is sufficient weak acid and pH adjusted inorganic ester salt over time to catalzye the hydrolysis, 2) to prevent the smoke from taking on the favor of the weak acid and the pH adjusted inorganic ester salt other than cellulose acetate that may adversely impact the taste attributes of the smoke, and 3) to facilitate bonding of the pill to the filaments of the tow by conventional tow binding materials, such as, for example, triacetin or glyceryl triacetate. The inner and outer layers may act together to control the release of the weak acid and the pH adjusted inorganic ester salt and the outer layer acts to mask the taste of the weak acid and the pH adjusted inorganic ester salt and inner layer, and facilitate bonding.

The inner layer is a water soluble material or a water permeable material. These materials may be any material that can encapsulate (i.e., contain the weak acid and the pH adjusted inorganic ester salt); but, when in contact with water, will either dissolve and thereby allow catalysis of the hydrolysis or allow water to pass and thereafter allow catalyst to escape. With the water soluble material, water will gel that material and the gelled material can then control the movement of water into the core or catalyst out of the core. Further, the gelled material may swell which then can rupture the outer layer. Encapsulation is important for, at least two reasons: first, encapsulation prevents premature hydrolysis, and second, maintains shelf-life of the product (filter). The water soluble matrix material and the water permeable materials are as described above.

The outer layer is cellulose acetate with a D.S. of 2.0-2.6. Cellulose acetate with a D.S. of 2.0-2.6 is water permeable. This cellulose acetate is preferably has the same or about the same (e.g., 'about the same' being where the D.S. being within ±25% of the filament tow) as the filament tow.

The amount of the inner layer and the outer layer should be sufficient to completely encapsulate (or surround) the weak acid and the pH adjusted inorganic ester salt. Completely encapsulate (or surround) refers to covering and isolating the weak acid and the pH adjusted inorganic ester salt, so that they cannot catalyze hydrolysis until water has permeated the outer layer and dissolved away at least a part of the water soluble material (or permeate the water permeable material) of the inner layer. For example, the inner layer may range from 5-100% by weight of the weak acid and the pH adjusted inorganic ester salt, or 5-30% by weight in another embodiment. The outer layer may range from 5-100% by weight or 5-30% by weight in another embodiment. Alternatively, the amount of the inner layer and the outer layer may be analogized with a rate of decay, i.e., 'half-life.' Half-life is the time required for the catalyst material to reduce the pH of the solution by of the initial pH. In the data presented below 1 mL of water is approximately equivalent to the volume of a standard cigarette filter. In the present invention, the half-life of the material should be at least 25 minutes, or in the range of 25-1000 minutes, or 50-500 minutes, or 75-300 minutes.

EXAMPLES

In the following example, the effect of pH adjustment of an inorganic ester salt and temperature on the degradation rate of cellulose acetate cigarette filters is investigated.

pH adjusted cellulose sulfate sodium salt was obtained as follows:

1. 2 grams of cellulose sulfate, sodium purchased from Fisher Scientific (Acros) was dissolved in 200 mL of de-ionized water with stirring. This makes a 1% solution.
2. Once dissolved, the solution pH was measured with a pH meter while the solution was continuously stirred. The solution pH was equal to 9.
3. 1 Molar hydrochloride acid was added drop wise using a 1000 microliter syringe until pH=7 was obtained.
4. Steps 1-3 were repeated to obtain 1% cellulose sulfate solution of pH's 5 and 3.
5. The control solution was 2 grams of cellulose sulfate, sodium dissolved in 200 mL of de-ionized water with stirring.
6. 2 grams of citric acid was added to each of the four solutions labeled pH=9, pH=7, pH=5, pH=3.

Filter rods were treated with the foregoing solutions as follows:

1. Paper was removed from 80 plasticized filter rods (24.45 mm×102 mm).
2. These rods were divided into 4 groups of 20.
3. 20 rods were dipped in pH=9 solution and allowed to saturate.
4. The rods were removed with tweezers, allowed to drain, and placed on a plastic sheet to air dry (3-4 days).
5. Step 3-4 was repeated for pH=7, pH=5, pH=3.
6. The dry rods were then split into groups of 10 rods and placed in jars.
7. The jars were labeled as follows:

| | |
|---|---|
| 21° Celsius pH = 9 | 30° Celsius pH = 9 |
| 21° Celsius pH = 7 | 30° Celsius pH = 7 |
| 21° Celsius pH = 5 | 30° Celsius pH = 5 |
| 21° Celsius pH = 3 | 30° Celsius pH = 3 |

The rods were tested for degree of substitution (DS) loss over time. The D.S. was calculated from the retention time based on known cellulose acetate standards. The high performance liquid chromatographic (HPLC) method is based on work by T. R. Floyd, Floyd, T. R. "Chemical Characterization of Cellulose Acetate by Non-exclusion Liquid Chromatography", *J. Chromatogr.* 1993, 629, 243-254. The advantage is D.S. can be calculated from small samples sized (<0.3 g). This offers a major advantage as compared to the traditional 2.0 gram wet titration method (ASTM D871-91). The HPLC method is not as accurate as the ASTM procedure; however the HPLC method easily tracks D.S. losses. The HPLC analysis is limited to a lower D.S. of 1.5. This is because cellulose acetate with a D.S. lower than 1.5 is not acetone soluble. Table 1 through 3 summarizes the results from the HPLC test. Table 3 compares the slopes of the regression equations. The data shows the lower the starting pH of the cellulose sulfate, sodium salt, the faster the plasticized cellulose acetate filter rod hydrolyze (degrade). Also, the degradation rate increases with temperature.

TABLE 1

| | Initial pH of Cellulose Sulfate | 21° Celsius Regression Equation for Degree of Substitution | Correlation Coefficient |
|---|---|---|---|
| Sample 1 | 9 | y = −0.0024x + 2.4757 | 0.985 |
| Sample 2 | 7 | y = −0.003x + 2.4625 | 0.982 |
| Sample 3 | 5 | y = −0.0031x + 2.4639 | 0.989 |
| Sample 4 | 3 | y = −0.0031x + 2.4659 | 0.995 |

TABLE 2

| | Initial pH of Cellulose Sulfate | 30° Celsius Regression Equation for Degree of Substitution | Correlation Coefficient |
|---|---|---|---|
| Sample 1 | 9 | y = −0.0037x + 2.4517 | 0.931 |
| Sample 2 | 7 | y = −0.0052x + 2.4669 | 0.999 |
| Sample 3 | 5 | y = −0.0053x + 2.4667 | 0.984 |
| Sample 4 | 3 | y = −0.008x + 2.5004 | 0.959 |

TABLE 3

| | Initial pH of Cellulose Sulfate | 21° Celsius, Rate increase base on pH[A] | 30° Celsius, Rate increase based on pH[A] | Rate increase based on temperature[B] |
|---|---|---|---|---|
| Sample 1 | 9 | 1 | 1 | 1.5 |
| Sample 2 | 7 | 1.3 | 1.4 | 1.7 |
| Sample 3 | 5 | 1.3 | 1.4 | 1.7 |
| Sample 4 | 3 | 1.3 | 2.2 | 2.6 |

A. This is the ratio of the regression slope of each sample each divided by Sample 1 regression slope.
B. This is the ratio of the regression slopes the same sample at the two temperatures: (Sample 1 at 30° C./Sample 1 at 21° C.).

The percent acetone insoluble material was determined for the 56 day sample. The samples were treated by the following procedure to obtain the acetone insoluble listed in Table 4.

1. 20 millimeter sample was cut from the treated filter rod and weighed
2. The sample was washed with water to remove citric acid, cellulose sulfate, sodium salt, acetic acid and any residual salts.
3. The samples were allowed to air dry for 3 days before the weights were recorded
4. The sample were dissolved in 10 mL of acetone, then filtered and rinsed with excess acetone.
5. The filtered material was allowed to air dry before the weights were recorded.

TABLE 4

| | Initial pH of Cellulose Sulfate | Weight of Water Extracted Sample-grams | Weight of Acetone Insoluble-grams | % Acetone Insoluble |
|---|---|---|---|---|
| Sample 1, 21° C. | 9 | 0.1203 | 0 | 0 |
| Sample 2, 21° C. | 7 | 0.1174 | 0.0065 | 5.54 |
| Sample 3, 21° C. | 5 | 0.1328 | 0.0102 | 7.68 |
| Sample 4, 21° C. | 3 | 0.1234 | 0.0135 | 10.94 |
| Sample 1, 30° C. | 9 | 0.1293 | 0.0106 | 8.20 |
| Sample 2, 30° C. | 7 | 0.1284 | 0.0165 | 12.85 |
| Sample 3, 30° C. | 5 | 0.1173 | 0.0169 | 14.41 |
| Sample 4, 30° C. | 3 | 0.1158 | 0.02 | 17.27 |

The data in Table 4 shows an inverse relationship between the initial pH of cellulose sulfate, sodium salt and the acetone insoluble percentage. The lower the initial pH of cellulose sulfate, sodium salt, the higher the percentage acetone insoluble. Increased temperature has a direct effect on the percent acetone insoluble material. This data demonstrate that plasticized cellulose acetate filter rods degrade or hydrolyze faster when treated with pH adjusted cellulose sulfate, sodium salt. The lower pH cellulose sulfate material is more susceptible organic acid catalyzed hydrolysis. Hydrolysis liberates sodium hydrogen sulfate, a strong mineral acid salt, with a pKa=1.9. The sodium hydrogen sulfate becomes the dominate catalyst which increases the degradation or hydrolysis of plasticized cellulose acetate filters. This offers design flexibility as to how fast one wants to degrade discarded cigarette filters/butts.

The present invention may be embodied in other forms without departing from the spirit and the essential attributes thereof, and, accordingly, reference should be made to the appended claims, rather than to the foregoing specification, as indicated the scope of the invention.

We claim:

1. An environmentally degradable cigarette filter where said cigarette filter includes a filter element of a bloomed cellulose acetate tow and a plug wrap surrounding said filter element further comprising:

a weak organic acid and a pH adjusted inorganic ester salt encapsulated in a matrix material, said pH adjusted inorganic ester salt having a pH less than or equal to 8, said matrix material encapsulating said weak acid and said pH adjusted inorganic ester salt being in contact with the tow.

2. The environmentally degradable cigarette filter of claim 1 wherein said pH being in a range of 1-8.

3. The environmentally degradable cigarette filter of claim 1 wherein said pH being in a range of 4-7.

4. The environmentally degradable cigarette filter of claim 1 wherein said pH adjusted inorganic ester salt comprising organosulfate salts and/or organophosphate salts.

5. The environmentally degradable cigarette filter of claim 4 wherein said pH adjusted organosulfate salt being selected from the group consisting of: ascorbyl sulfate salt, cellulose sulfate salt, glucose sulfate salt, inositol hexasulfate salt, lauryl sulfate salt, octyl sulfate salt, starch sulfate salt, sucrose octasulfate salt, and combinations thereof.

6. The environmentally degradable cigarette filter of claim 1 wherein said weak organic acid being selected from the group consisting of ascorbic acid, citric acid, lactic acid, nicotinic acid, hydroxysuccinic acid (apple acid), and combinations thereof.

7. The environmentally degradable cigarette filter of claim 1 wherein said matrix material being a water-soluble material and/or a water permeable material.

8. The environmentally degradable cigarette filter of claim 7 wherein said water-soluble matrix material being selected from the group consisting of: cellulose acetate (D.S.=0.8 ±0.2), carboxymethyl cellulose, ethyl cellulose, hydroxypropyl cellulose, hydroxypropyl methyl cellulose, methyl cellulose, polyethylene glycol, polyvinyl acetate, polyvinyl alcohol, starch, sugar, and combinations thereof.

9. The environmentally degradable cigarette filter of claim 7 wherein said water permeable material being selected from the group consisting of: ethyl cellulose, shellac, zein, cellulose acetate (D.S.=2.0-2.6), cellulose phthalate, porous silicone elastomers, acrylic esters, and combinations thereof.

10. An environmentally degradable cigarette filter where said cigarette filter includes a filter element of a bloomed cellulose acetate tow and a plug wrap surrounding said filter element further comprising:

a pill including a weak acid and a pH adjusted inorganic ester salt, said pH adjusted ester salt having a pH less than or equal to 8 surrounded by an inner layer of a water-soluble or water permeable material, and an outer layer of a cellulose acetate having a D.S. in the range of 2.0-2.6 surrounding said inner layer.

11. The environmentally degradable cigarette filter of claim 10 wherein said pH being in a range of 1-8.

12. The environmentally degradable cigarette filter of claim 10 wherein said pH being in a range of 4-7.

13. The environmentally degradable cigarette filter of claim 10 wherein said pH adjusted inorganic ester salt comprising organosulfate salts and/or organophosphate salts.

14. The environmentally degradable cigarette filter of claim 13 wherein said pH adjusted organosulfate salt being selected from the group consisting of: ascorbyl sulfate salt, cellulose sulfate salt, glucose sulfate salt, inositol hexasulfate salt, lauryl sulfate salt, octyl sulfate salt, starch sulfate salt, sucrose octasulfate salt, and combinations thereof.

15. The environmentally degradable cigarette filter of claim 10 wherein said weak organic acid being selected from the group consisting of ascorbic acid, citric acid, lactic acid, nicotinic acid, hydroxysuccinic acid (apple acid), and combinations thereof.

16. The environmentally degradable cigarette filter of claim 10 wherein said matrix material being a water-soluble material and/or a water permeable material.

17. The environmentally degradable cigarette filter of claim 16 wherein said water-soluble matrix material being selected from the group consisting of: cellulose acetate (D.S.=0.8 ±0.2), carboxymethyl cellulose, ethyl cellulose, hydroxypropyl cellulose, hydroxypropyl methyl cellulose, methyl cellulose, polyethylene glycol, polyvinyl acetate, polyvinyl alcohol, starch, sugar, and combinations thereof.

18. The environmentally degradable cigarette filter of claim 16 wherein said water permeable material being selected from the group consisting of: ethyl cellulose, shellac, zein, cellulose acetate (D.S.=2.0-2.6), cellulose phthalate, porous silicone elastomers, acrylic esters, and combinations thereof.

* * * * *